US010350646B1

(12) United States Patent
Nichols, Jr.

(10) Patent No.: US 10,350,646 B1
(45) Date of Patent: Jul. 16, 2019

(54) AUTOMATED SURFACE SCRAPING APPARATUS

(71) Applicant: Kraig Darrell Nichols, Jr., Port St. Lucie, FL (US)

(72) Inventor: Kraig Darrell Nichols, Jr., Port St. Lucie, FL (US)

( * ) Notice: Subject to any disclaimer, the term of this patent is extended or adjusted under 35 U.S.C. 154(b) by 325 days.

(21) Appl. No.: 15/456,774

(22) Filed: Mar. 13, 2017

Related U.S. Application Data

(60) Provisional application No. 62/307,049, filed on Mar. 11, 2016.

(51) Int. Cl.
*B26B 3/00* (2006.01)
*B08B 1/00* (2006.01)
*A47L 13/02* (2006.01)

(52) U.S. Cl.
CPC ..... *B08B 1/005* (2013.01); *A47L 13/02* (2013.01); *B26B 3/00* (2013.01)

(58) Field of Classification Search
CPC . B27B 19/02; B26B 3/00; A47L 13/02; A47L 13/022; B08B 1/005
See application file for complete search history.

(56) References Cited

U.S. PATENT DOCUMENTS 5,056,385 A 10/1991 Petersen
5,996,231 A 12/1999 Roche et al.
6,519,801 B1 2/2003 Chao
6,715,210 B2 * 4/2004 Chao ..... B44D 3/162 30/169
6,854,187 B2 2/2005 Huan
6,978,704 B2 * 12/2005 Cheng ..... B25B 7/123 81/368
7,814,608 B1 10/2010 Catello
7,930,831 B2 4/2011 Lin
8,356,415 B2 1/2013 Lin
10,207,393 B2 * 2/2019 Wu ..... B25B 7/123
2009/0188116 A1 * 7/2009 van Deursen ..... A47L 13/022 30/170

* cited by examiner

*Primary Examiner* — Shay Karls
(74) *Attorney, Agent, or Firm* — Glenn E. Gold, P.A.; Glenn E. Gold

(57) ABSTRACT

An automated surface scraping apparatus basically includes a handle formed by an elongated shaft and a hand grip attached to a rear end portion of the handle shaft, and an automated scraper head attached to a base extension mounted along a front end portion of the handle shaft. The automated scraper head basically includes a hand-operated locking-and-releasing mechanism mounted to the base extension, and a clamping jaw connected to and extending forwardly from the locking-and-releasing mechanism. The clamping jaw includes a lower jaw member, being fixed or stationary relative to the base extension and the locking-and-releasing mechanism, and an upper jaw member, being pivotally movable relative to the lower jaw member and the locking-and-releasing mechanism between engaged and disengaged orientations relative to a scraper blade.

20 Claims, 10 Drawing Sheets

AUTOMATED SURFACE SCRAPING APPARATUS

CROSS-REFERENCE TO RELATED APPLICATION(S)

This U.S. non-provisional U.S. patent application claims the benefit of U.S. provisional patent application Ser. No. 62/307,049, filed Mar. 11, 2016, which is hereby incorporated-by-reference in its entirety.

FIELD OF THE INVENTION

The present invention relates to surface maintenance, and more particularly, is concerned with an automated surface scraping apparatus.

BACKGROUND OF THE INVENTION

Multiple surfaces are found at construction job sites and commercial and industrial buildings that require maintenance by workers on a frequent basis. Such maintenance entails workers scraping these surfaces. Some examples are: flooring contractors using scrapers to remove glue, adhesive, paint, etc. from stone, wood, metal, concrete and glass surfaces; janitors, maintenance men and other workers using scrapers to remove gum or garbage from floors in malls, large or small business facilities and airports; and home owners and do-it-yourself (DIY) handymen using scrapers to remove many different materials from a range of different surfaces, such as grease from cook stove tops, dirt and dust from household window panes, and ice from vehicle windshields.

One prior art standard floor scraper 300 is illustrated in FIGS. 1 and 2 herein. The prior art scraper 300 includes an elongated handle 302, a hand grip 304 attached to a rear end portion of the handle and a scraper head 306 attached to a front end portion of the handle. The scraper head 306 incorporates lower and upper jaw members 308, 310. The lower jaw member 308 is a part of the scraper head 306 that is affixed to the front end portion of the handle 302. The lower jaw member 308 has a forward and upward opening recess 312 of dimensions to receive both the upper jaw member 310 and a planar scraper blade 314. The upper jaw member 310 is the part of the scraper head 306 that is removably attachable upon the lower jaw member 308 so as to releasably clamp and secure the scraper blade 314 between them within the recess 312 of the lower jaw member 308. Also, the lower jaw member 308 has a plurality of threaded holes 316 located within the recess 312 of the lower jaw member 30 and formed in a laterally spaced apart relationship from one another. The upper jaw member 310 has a like plurality of threadless holes 318 aligned with the threaded holes 316 of the lower jaw member 308. A like plurality of screws 320 may be inserted through the threadless holes 318 in the upper jaw member 310 and fastened into the threaded holes 316 in the lower jaw member 308 so as to clamp and secure the scraper blade 314 between them with a front edge **314*a* of the scraper blade 314 projecting forwardly from the lower and upper jaw members 308, 310 of the scraper head 306 so as to expose the front edge 314*a*** in order that it is able to contact a surface for scraping.

This standard floor scraper embodies several shortcomings. An example of a shortcoming faced with a standard floor scraper is that a separate tool, such as a screwdriver, is required for changing the scraper blade in view that Phillips or flat head screws are most commonly used to clamp the blade. These screws tend to strip out or break, which then requires the user to extract the broken screws and replace them with new ones. Furthermore, screws don't always stay tight and that oftentimes results in over tightening the screws which can eventually result in damage to the threaded holes in the lower jaw. Apart from the shortcomings offered by the usage of screws the standard floor scraper has a small recess area therebetween the upper and lower portion of the jaw, wherein the scraper blade rests. Because of such a small recess area, all too often, the blade resting therebetween the upper and lower portion of the jaw slips inward, thereby neutralizing the functionality of the scraper.

Accordingly, there remains a need in the art for an innovation that overcomes the deficiencies of past approaches and the problems that remain unsolved with respect to scraping and cleaning multiple surfaces.

SUMMARY OF THE INVENTION

The present invention is directed to an innovation that overcomes the deficiencies of past approaches and the problems that remain unsolved by providing an automated surface scraping apparatus that is simple to make ready for use without the assistance of any tools, easy to use, and dependable and reliable in assisting workers in carrying out the tasks.

In one aspect of the present invention, an automated surface scraping apparatus includes:

an elongated handle shaft; and an automated scraper head including a base extension fixedly attached to, and disposed along a front end portion of, the elongated handle shaft, the base extension and the front end portion of the elongated handle shaft both having hollow portions and being slotted along at least respective upper sides of the hollow portions so as to form channels therein with the base extension being at least partially disposed within the channel of the front end portion of the elongated handle shaft, a clamping jaw including lower and upper jaw members pivotally movable toward and away from one another between engaged and disengaged orientations relative to a scraper blade, each of the lower and upper jaw members having a forward clamping portion and a rearward coupling portion integrally connected to one another, the rearward coupling portion of the lower jaw member being affixed to the base extension and extending forwardly from the base extension and the front end portion of the elongated handle shaft, the rearward coupling portion of the upper jaw member being pivotally coupled at a first location thereon to the base extension, and a locking-and-releasing mechanism pivotally coupled to the rearward coupling portion of the upper jaw member at a second location thereon spaced from the first location and coupled to the rearward coupling portion of the upper jaw member at an intermediate location thereon spaced between the first and second locations, the locking-and-releasing mechanism also being mounted to the base member and actuatable by a user to convert between unlocked and locked orientations relative to the clamping jaw so as to cause pivotal movement of the upper jaw member relative to the lower jaw member between the disengaged and engaged orientations to effect corresponding unclamping and clamping of the scraper blade by the clamping jaw;

wherein the forward clamping portions of the lower and upper jaw members project laterally in opposite directions to opposite sides thereof disposed beyond and in a transverse relationship to respective opposite sides of the base extension, the elongated handle shaft and the locking-and-releasing mechanism;

also wherein the forward clamping portion of the lower jaw member has a lower front recess formed therein and the forward clamping portion of the upper jaw member has an upper front lip formed thereon, the lower front recess and upper front lip respectively extending between the opposite sides of the forward clamping portions of the lower and upper jaw members and beyond the respective opposite sides of the base extension, the elongated handle shaft and the locking-and-releasing mechanism, the lower front recess and upper front lip having respective dimensions that receive and clamp therebetween the scraper blade at opposite upper and lower surfaces thereof.

In another aspect of the present invention, the locking-and-releasing mechanism of the automated scraper head includes:

an adjustment screw member at least partially disposed within the channel of, and being rotatably and threadably mounted to, the base extension of the automated scraper head;

a toggle member having a rear end engaged with a front end of the adjustment screw member such that the toggle member is movable along, and relative to, the base extension upon rotation of the adjustment screw member relative to the base extension; and a locking lever pivotally connected at a front end to the second location on the rearward coupling portion of the upper jaw member of the clamping jaw, the locking lever also pivotally connected to a front end of the toggle member at a location on the locking lever between the front end and a rear end of the locking lever but closer to the front end than the rear end of the locking lever.

In another aspect of the present invention, the locking-and-releasing mechanism of the automated scraper head also includes an elongated extensible spring attached to and extending from an intermediate location on the base extension between opposite ends of the base extension to the intermediate location on the rearward coupling portion of the upper jaw member such that the elongated extensible spring is in a constant stretched state so as to impose a force upon the upper jaw member and thereby upon the locking lever to maintain the rear end of the toggle member engaged with the front end of the adjustment screw member as the upper jaw member pivotally moves toward and away from the lower jaw member.

In another aspect of the present invention, the locking-and-releasing mechanism of the automated scraper head also includes a knob affixed at a rear end of the adjustment screw member and being rotatable by a user to threadably adjust the position of the adjustment screw member relative to and along the base extension and thereby the front end of the adjustment screw member relative to the rear end of the toggle member to thereby urge the locking lever to assume a locked orientation relative to the toggle member such that the lower and upper jaw members the engaged orientation relative to the scraper blade.

In another aspect of the present invention, the locking-and-releasing mechanism of the automated scraper head also includes a releasing lever having an intermediate portion pivotally coupled to the locking lever, a rear portion disposed adjacent to a rear portion of the locking lever, and a forward end engaged with an intermediate portion of the toggle member so as to place the locking-and-releasing mechanism at the locked orientation such that by a user squeezing the releasing lever at the rear portion thereof toward the rear portion of the locking lever the releasing lever disengages from the toggle member and thereby the locking-and-releasing mechanism converts from the locked orientation to the unlocked orientation thereby enabling pivotal movement of the upper jaw member relative to the lower jaw member from the engaged orientation to the disengaged orientation to enable the scraper blade to be inserted, or removed from, between the upper and lower jaw members of the clamping jaw.

In another aspect of the present invention, an automated surface scraping apparatus includes:

an elongated handle shaft;

an automated scraper head including a base extension fixedly attached to, and disposed along a front end portion of, the elongated handle shaft, the base extension and the front end portion of the elongated handle shaft both having hollow portions and being slotted along at least respective upper sides of the hollow portions so as to form channels therein with the base extension being at least partially disposed within the channel of the front end portion of the elongated handle shaft, a clamping jaw including lower and upper jaw members pivotally movable toward and away from one another between disengaged and engaged orientations relative to a scraper blade, each of the lower and upper jaw members having a forward clamping portion and a rearward coupling portion integrally connected to one another, the rearward coupling portion of the lower jaw member being affixed to the base extension and extending forwardly from the base extension and the front end portion of the elongated handle shaft, the rearward coupling portion of the upper jaw member being pivotally coupled at a first location thereon to the base extension, and a locking-and-releasing mechanism pivotally coupled to the rearward coupling portion of the upper jaw member at a second location thereon spaced from the first location and coupled to the rearward coupling portion of the upper jaw member at an intermediate location thereon spaced between the first and second locations, the locking-and-releasing mechanism also being mounted to the base extension and actuatable by a user to convert between unlocked and locked orientations relative to the clamping jaw so as to cause pivotal movement of the upper jaw member relative to the lower jaw member between the disengaged and engaged orientations to effect corresponding unclamping and clamping of the scraper blade by the clamping jaw; and an actuating mechanism disposed along the front end portion of the elongated handle shaft and pivotally coupled to the locking-and-releasing mechanism such that by a user pressing on the actuating mechanism the locking-and-releasing mechanism converts from the locked orientation to the unlocked orientation thereby enabling pivotal movement of the upper jaw member relative to the lower jaw member from the engaged orientation to the disengaged orientation so as to enable the scraper blade to be inserted, or removed from, between the upper and lower jaw members of the clamping jaw;

wherein the forward clamping portions of the lower and upper jaw members project laterally in opposite directions to opposite sides thereof disposed beyond and in a transverse relationship to respective opposite sides of the base extension, the elongated handle shaft and the locking-and-releasing mechanism;

also wherein the forward clamping portion of the lower jaw member has a lower front recess formed therein and the forward clamping portion of the upper jaw member has an upper front lip formed thereon, the lower front recess and upper front lip respectively extending between the opposite sides of the forward clamping portions of the lower and upper jaw members and beyond the respective opposite sides of the base extension, the elongated handle shaft and the locking-and-releasing mechanism, the lower front recess and upper front lip having respective dimensions that receive and clamp therebetween the scraper blade at opposite upper and lower surfaces thereof.

In another aspect of the present invention, the forward clamping portions of the lower and upper jaw members also have configurations that flare forwardly and outwardly in opposite directions from the respective opposite sides of the base extension, the elongated handle shaft and the locking-and-releasing mechanism.

In another aspect of the present invention, an automated surface scraping apparatus includes:

an elongated handle shaft;

an automated scraper head including a base extension fixedly attached to, and disposed along a front end portion of, the elongated handle shaft, the base extension and the front end portion of the elongated handle shaft both having hollow portions and being slotted along at least respective upper sides of the hollow portions so as to form channels therein with the base extension being at least partially disposed within the channel of the front end portion of the elongated handle shaft, a clamping jaw including lower and upper jaw members pivotally movable toward and away from one another between disengaged and engaged orientations relative to a scraper blade, each of the lower and upper jaw members having a forward clamping portion and a rearward coupling portion integrally connected to one another, the rearward coupling portion of the lower jaw member being affixed to the base extension and extending forwardly from the base extension and the front end portion of the elongated handle shaft, the rearward coupling portion of the upper jaw member being pivotally coupled at a first location thereon to the base extension, and a locking-and-releasing mechanism pivotally coupled to the rearward coupling portion of the upper jaw member at a second location thereon spaced from the first location and coupled to the rearward coupling portion of the upper jaw member at an intermediate location thereon spaced between the first and second locations, the locking-and-releasing mechanism also being mounted to the base extension and actuatable by a user to convert between unlocked and locked orientations relative to the clamping jaw so as to cause pivotal movement of the upper jaw member relative to the lower jaw member between the disengaged and engaged orientations to effect corresponding unclamping and clamping of the scraper blade by the clamping jaw; and an actuating mechanism disposed along the front end portion of the elongated handle shaft and having a front end portion pivotally coupled to the locking-and-releasing mechanism and also disposed in a cam action relationship with the base extension of the automated scraper head such that by a user pressing on the actuating lever the locking-and-releasing mechanism converts from the locked orientation to the unlocked orientation thereby enabling pivotal movement of the upper jaw member relative to the lower jaw member from the engaged orientation to the disengaged orientation so as to enable the scraper blade to be inserted, or removed from, between the upper and lower jaw members of the clamping jaw;

wherein the forward clamping portions of the lower and upper jaw members project laterally in opposite directions to opposite sides thereof disposed beyond and in a transverse relationship to respective opposite sides of the base extension, the elongated handle shaft and the locking-and-releasing mechanism, the forward clamping portions of the lower and upper jaw members also having configurations that flare forwardly and outwardly in opposite directions from the respective opposite sides of the base extension, the elongated handle shaft and the locking-and-releasing mechanism;

also wherein the forward clamping portion of the lower jaw member has a forwardly and upwardly facing lower front recess formed therein and the forward clamping portion of the upper jaw member has a forwardly and downwardly projecting upper front lip formed thereon, the lower front recess and upper front lip respectively extending between opposite sides of the forward clamping portions of the lower and upper jaw members and beyond the respective opposite sides of the base extension, the elongated handle shaft and the locking-and-releasing mechanism, the lower front recess and upper front lip having respective dimensions that receive and clamp therebetween the scraper blade at opposite upper and lower surfaces thereof.

In another aspect of the present invention, the actuating mechanism comprises:

a releasing lever disposed along the front end portion of the elongated handle shaft and having a front end pivotally coupled to the rear end of a locking lever of the locking-and-releasing mechanism;

a push button affixed on a rear end of the releasing lever; and a protrusion affixed on the releasing lever below and offset rearward from the front end of the releasing lever and disposed in the cam action relationship with a bracket on the base extension such that by the user pressing on the push button of the releasing lever the locking lever is pivoted away from a toggle member of the locking-and-releasing mechanism and thereby converted from the locked orientation to the unlocked orientation relative to the toggle member thereby enabling pivotal movement of the upper jaw member relative to the lower jaw member from the engaged orientation to the disengaged orientation so as to enable the scraper blade to be inserted, or removed from, between the upper and lower jaw members of the clamping jaw.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
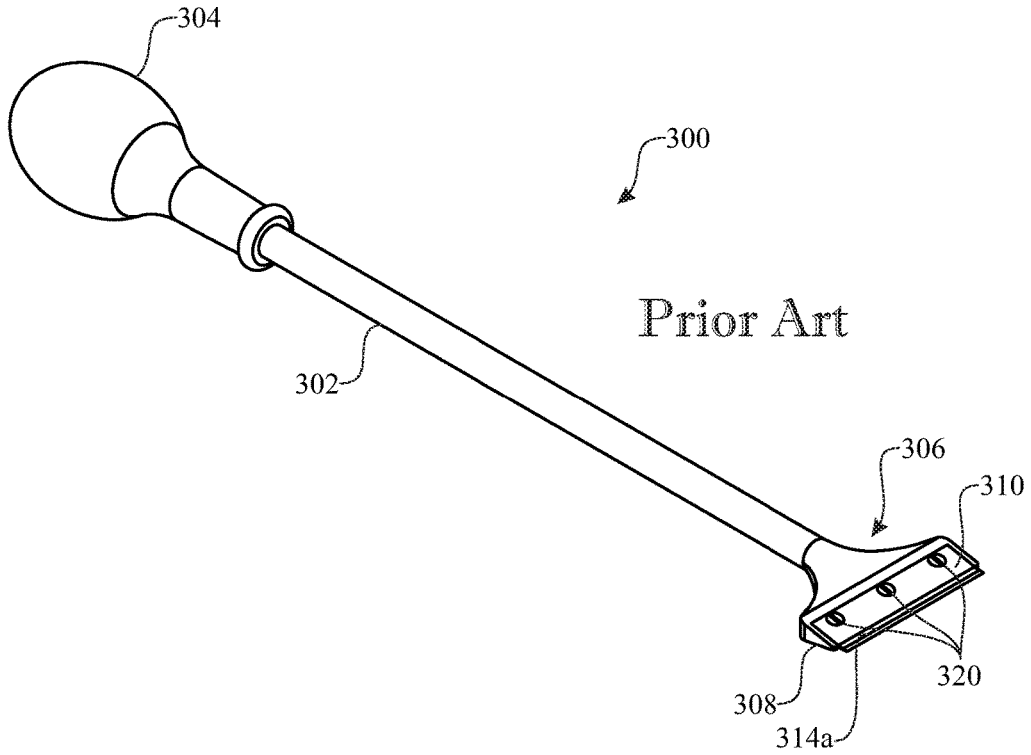
FIG. 1 presents a top front isometric view of a prior art standard floor scraper showing lower and upper jaw members of a scraper head at a forward end of a handle of the scraper being secured together by a plurality of screws so as to clamp a scraper blade between the lower and upper jaw members making the scraper ready for use.
Figure 2:
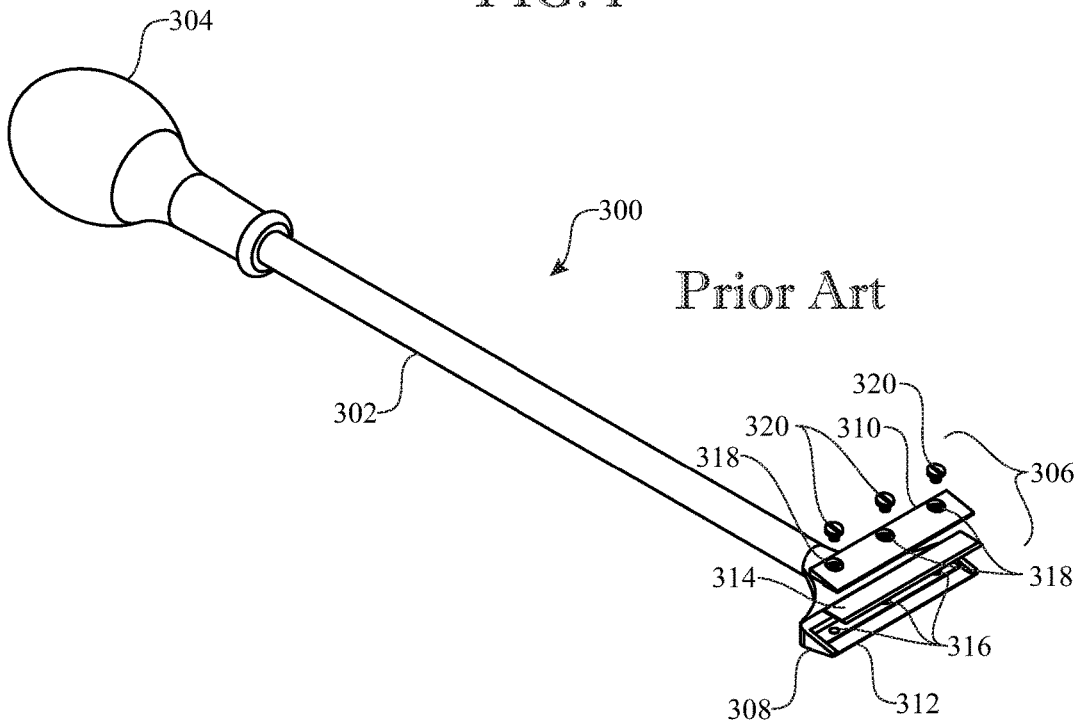
FIG. 2 presents a top front isometric view of the scraper originally introduced in FIG. 1, showing the plurality of screws and thereby the upper jaw member removed from the lower jaw member of the scraper head so as to release the scraper blade from the scraper head.
Figure 3:
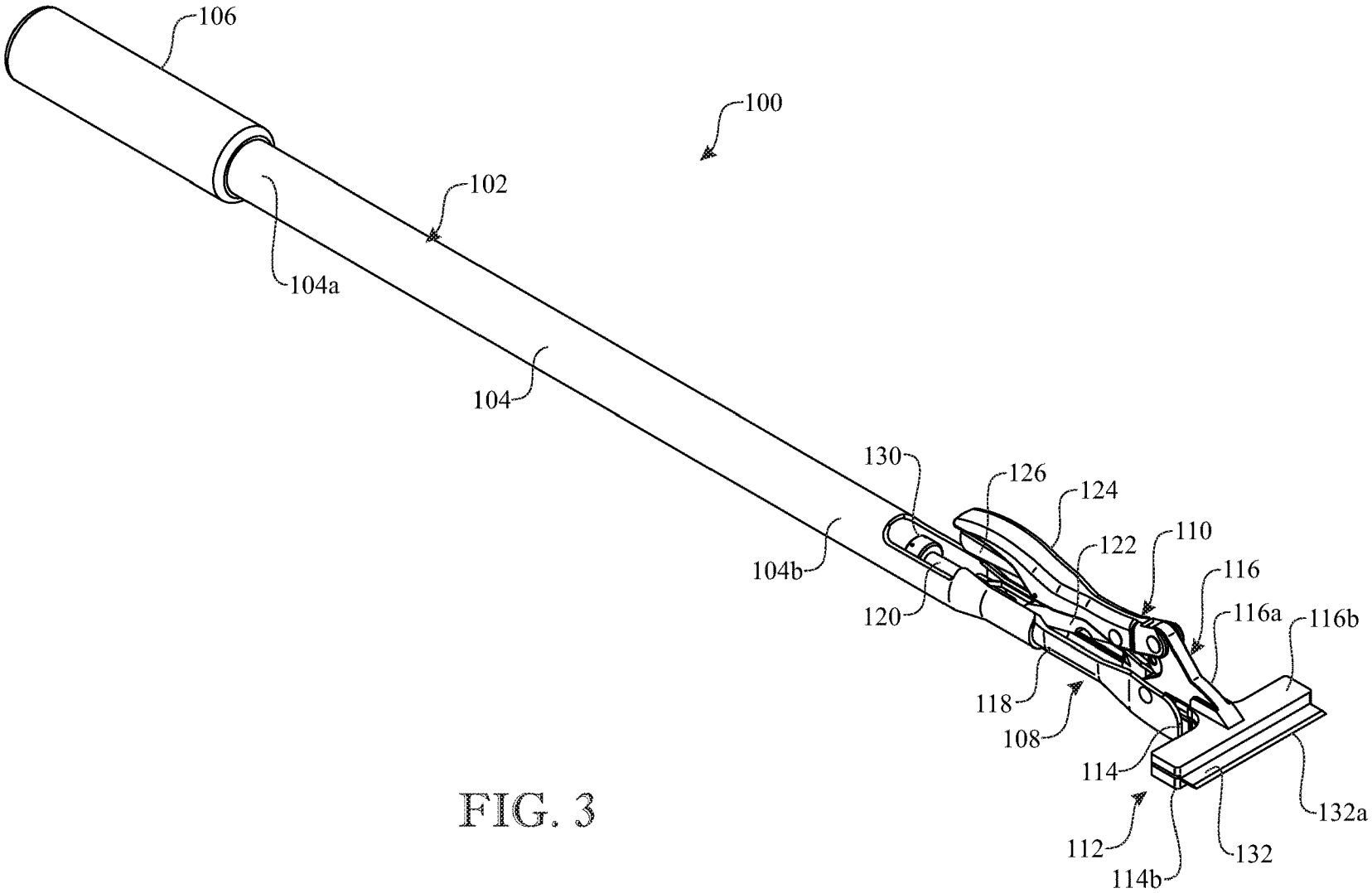
FIG. 3 presents a top front isometric view of one exemplary embodiment of an automated surface scraping apparatus in accordance with aspects of the present invention, showing an automated scraper head of the scraping apparatus in an engaged orientation in which lower and upper jaw members of the scraper head are clamped on a scraper blade such that a front edge portion of the blade projects forwardly of the jaw members.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 3. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 3-8, there is illustrated an exemplary embodiment of an automated surface scraping apparatus, generally designated 100, in accordance with aspects of the present invention. The scraping apparatus 100 basically includes a handle 102 formed by an elongated shaft 104 and a hand grip 106 attached to a rear end portion 104*a* of the shaft 104, and an automated scraper head 108 attached to a front end portion 104*b* of the handle shaft 104. The automated scraper head 108 basically includes a hand-operated locking-and-releasing mechanism 110 and a clamping jaw 112 connected to and extending forwardly from the locking-and-releasing mechanism 110. The clamping jaw 112 includes a lower jaw member 114, being fixed or stationary relative to the locking-and-releasing mechanism 110, and an upper jaw member 116, being pivotally movable relative to the lower jaw member 114 and the locking-and-releasing mechanism 110. The scraping apparatus 100 may be fabricated from a suitable material, by way of example but not limitation, steel, fiberglass or plastic, using known construction techniques.

More particularly, the automated scraper head 108 includes a base extension 118. The locking-and-releasing mechanism 110 of the automated scraper head 108 includes an adjustment screw member 120, a toggle member 122, a movable locking lever 124, a movable releasing lever 126, and an elongated extensible spring 128. The base extension 118 is fixedly attached at its rear end portion 118*a* to the front end portion 104*b* of the handle shaft 104. Both the base extension 118 and the front end portion 104*b* of the handle shaft 104 are hollow and also slotted along respective upper sides thereof so as to form channels therein. The handle extension 118 at its front end portion 118*b* is fixedly attached to a rearward coupling portion 114*a* of the lower jaw member 114 of the clamping jaw 112.

The adjustment screw member 120 of the locking-and-releasing mechanism 110 at its middle portion 120*a*, located intermediately between its rear and front end portions 120*b*, 120*c* and being externally threaded, is rotatably and theadably coupled within an internally threaded surface 118*c* in the rear end portion 118*a* of the base extension 118. The rear end portion 120*b* of the adjustment screw member 120 extends into the front end portion 104*b* of the handle shaft 104 through a distance sufficient to expose a knob 130, provided on the rear end portion 120*b* of the adjustment screw member 120, via the open channel of the front end portion 104*b* of the handle shaft 104 to access by the fingers of a user for turning the adjustment screw member 120 relative to the base extension 118 to make a desired adjustment, the purpose of which will be described hereinafter.

Figure 7:
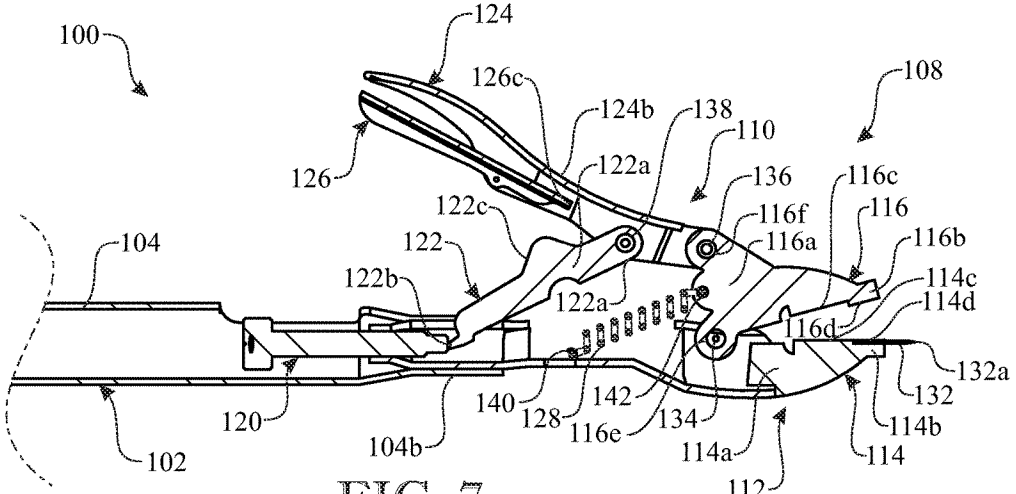
FIG. 7 presents a longitudinal section view of the automated surface scraping apparatus on a slightly enlarged scale, showing the automated scraper head in the disengaged orientation of FIG. 4 as seen along section line 7--7 in FIG. 6.
Figure 8:
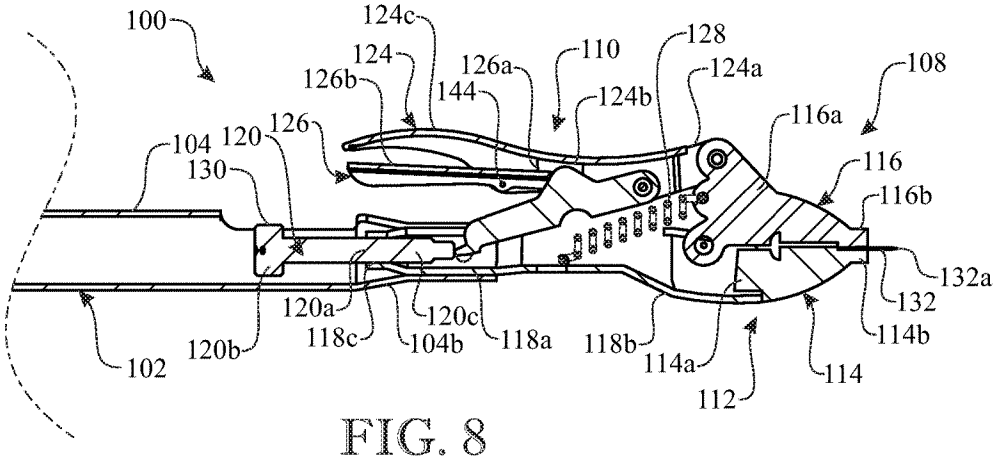
FIG. 8 presents a longitudinal section view of the automated surface scraping apparatus on the same scale as in FIG. 7, showing the automated scraper head in the engaged orientation of FIG. 3.

As best seen in FIGS. 7 and 8, the stationary lower jaw member 114 of the clamping jaw 112, being fixedly attached at its rearward coupling portion 114*a* to the front end portion 118*b* of the base extension 118, has a front lower clamping portion 114*b* merging from the rearward coupling portion 114*a* so as to project laterally in opposite directions from and in a transverse relationship to the rearward coupling portion 114*a*. The rearward coupling portion 114 and front lower clamping portion 114*b* of the stationary lower jaw member 114 together define an upwardly-facing surface 114*c* with a forwardly- and upwardly-opening recess 114*d*. The recess 114*d* has dimensions configured to snugly receive a planar scraper blade 132 so that a front edge 132*a* thereof projects forwardly from the front lower clamping portion 114*b* of the lower jaw member 114. Furthermore, the recess 114*d* is configured to prevent the planar scraper blade 132 from slipping therebetween upper and lower clamping portions 116*b*, 114*b* of the jaw member 114.

The movable upper jaw member 116 of the clamping jaw 112 has a rearward coupling portion 116*a* and a front upper clamping portion 116*b* merging from the rearward coupling portion 116*a* so as to project laterally in opposite directions from and in a transverse relationship to the rearward coupling portion 116*a*. The rearward coupling portion 116*a* and front upper clamping portion 116*b* of the movable upper jaw member 116 together define a downwardly-facing surface 116*c* with a downwardly-protruding front upper lip 116*d* having dimensions configured so that the downwardly-facing surface 116*c* aligns with and fits adjacent to the upwardly-facing surface 114*c* of the rear body portion 114*a* of the stationary lower jaw member 114 and the downwardly-protruding front upper lip 116*d* aligns with and fit within the forwardly- and upwardly-opening recess 114*d* of the front lower clamping portion 114*b* of the stationary lower jaw member 114 so as to clamp the planar scraper blade 132 between them, as seen in FIG. 8. The rearward coupling portion 116*a* of the movable upper jaw member 116 has a rear lower eyelet 116*e* at which the movable upper jaw member 116 is pivotally connected by a lower coupler 134 to the front end portion 118*b* of the base extension 118 at a location rearward from the stationary lower jaw member 114 such that the movable upper jaw member 116 may be pivotally moved relative to the base extension 118 and toward and away from the stationary lower jaw member 114, between the disengaged orientation as seen in FIG. 7 and the engaged orientation as seen in FIG. 8.

Figure 9:
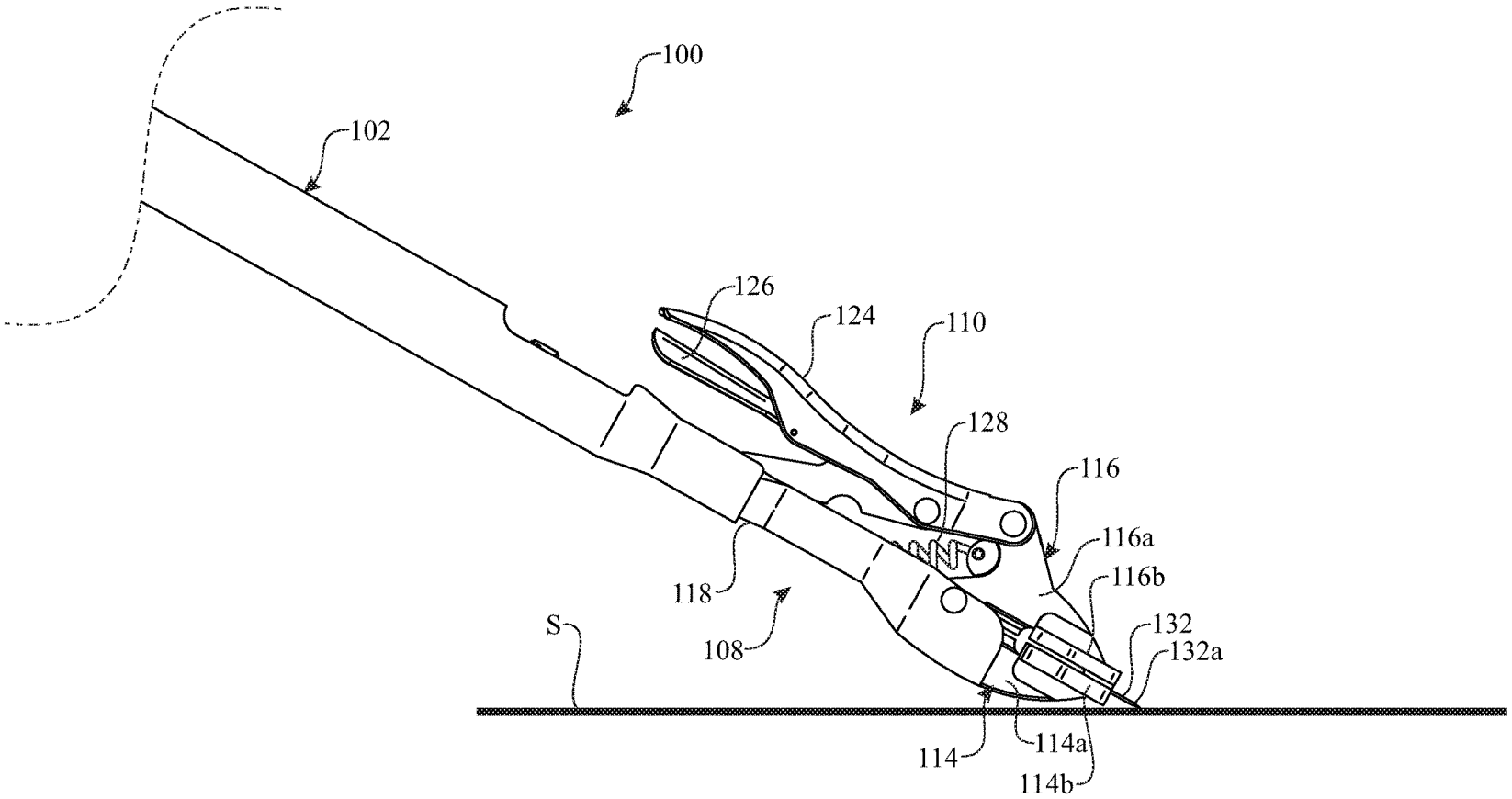
FIG. 9 presents a side elevation view of the automated surface scraping apparatus showing the automated scraper head in the engaged orientation and also in an inclined position in which the scraper blade is inclined for use in scraping a surface.

Also, while in the engaged orientation of the automated scraper head 108 as seen in FIGS. 8 and 9, the handle shaft 104, base extension 118 and adjustment screw member 120 of the locking-and-releasing mechanism 110 of the automated scraper head 108, and the upwardly-facing surface 114*c* of the lower jaw member 114 and downwardly-facing surface 116*c* of the upper jaw member 116 of the clamping jaw 112 are all substantially aligned with one another along a line of a force that projects to the front edge 132*a* of the clamped scraper blade 132 when a user grips the handle 102 of the apparatus 100 and drives it forwardly to scrape a surface S, such as shown in FIG. 9. The automated scraper head 108 is maintained in the engaged orientation by establishing and maintaining a locking relationship between various components of its locking-and-releasing mechanism 110. The triangular configuration of the rear body portion 116*a* of the movable upper jaw member 116 of the clamping jaw 112 contributes to facilitating the establishment and maintenance of this locking relationship. The at the front upper clamping portion 116*b*. This permits provision of a rear upper eyelet 116*f* on the rearward rearward coupling portion 116*a* of the movable upper jaw member 116, in being substantially right-triangular in configuration, tapers upwardly and rearwardly from the front upper clamping portion 116*b* of the movable upper jaw member 116 to a height being substantially greater than coupling portion 116*a* of the movable upper jaw member 116 at which the movable upper jaw member 116 is pivotally connected by an upper coupler 136 to the movable locking lever 124 of the locking-and-releasing mechanism 110. The distance between the lower and upper eyelets 116*e*, 116*f*, and thereby the lower and upper couplers 134, 136, provides an angular displacement of the movable upper jaw member 116 relative to the stationary lower jaw member 114 when the automated scraper head 108 is at the disengaged orientation, as seen respectively in FIG. 7, to facilitate easy insertion and removal of the planar scraper blade 132.

The movable locking lever 124 of the locking-and-releasing mechanism 110 is movable between unlocked and locked orientations, as shown in FIGS. 7 and 8. The distance between the lower and upper eyelets 116*e*, 116*f*, and thereby the lower and upper couplers 134, 136, also provides sufficient angular displacement of the movable locking lever 124 of the locking-and-releasing mechanism 110 between the unlocked and locked orientations and the automated scraper head 108 between the disengaged and engaged orientations, as shown in FIGS. 7 and 8. The movable locking lever 124 has the configuration of an inverted U-shaped channel with a pair of spaced apart front tabs 124*a* protruding along opposite sides of the rear upper eyelet 116*f* on the rearward coupling portion 116*a* of the movable upper jaw member 116, as seen in FIGS. 3-6, where the front tabs 124*a* are pivotally connected to the rear upper eyelet 116*f* by the upper coupler 136. The toggle member 122 of the locking-and-releasing mechanism 110 at a front end portion 122*a* fits into the channel of the movable locking lever 124 and is pivotally connected by a third coupler 138 to a forward portion 124*b* of the locking lever 124.

The toggle member 122 also has a rear end portion in the form of a first protrusion 122*b* which is forceably engaged and held against the front end portion 120*c* of the adjustment screw member 120 by a rearwardly-directed biasing force generated by the elongated extensible spring 128 being in an extended or stretched condition. The spring 128 is interconnected in the extended or stretched condition between a hook 140 attached on the handle extension 118 and an aperture 142 defined in the rearward coupling portion 116*a* of the movable upper jaw member 116 about midway between its lower and upper eyelets 116*e*, 116*f*. The stretched spring 128 biases the movable upper jaw member 116 toward undergoing pivotal movement in the rearward, or counterclockwise, direction about the lower coupler 134. The rearwardly-directed biasing force of the spring 128 is transmitted through the movable upper jaw member 116 and the movable locking lever 124 to the toggle member 122 such that the stretched spring 128 thus indirectly causes biasing of the toggle member 122 toward the adjustment screw member 120 such that the first protrusion (rear end portion) 122*b* of the toggle member 122 is forceably held against the front end portion 120*c* of the adjustment screw member 120 during rotatable adjustment of the adjustment screw member 120, displacement of the movable locking lever 124 of the locking-and-releasing mechanism 110 between the unlocked and locked orientations, and transition of the automated scraper head 108 between the disengaged and engaged orientations, as shown in FIGS. 7 and 8.

The toggle member 122 also has a second protrusion 122*c* locate intermediately between its front and rear end portions 122*a*, 122*b*, protruding in a direction away from the base extension 118 and toward the movable releasing lever 126 mounted to the movable locking lever 124. Intermediately between its opposite ends the movable releasing lever 126 is pivotally mounted by a pivot pin 144 to a handle grip rearward portion 124*c* of the movable locking lever 124. The movable releasing lever 126 extends in opposite directions from the pivot pin 144 forwardly into and rearwardly from the inverted U-shaped channel of the movable locking lever 124. The movable releasing lever 126 has a forward portion 126*a* extending from the pivot pin 144 toward the toggle member 122 and a rearward portion 126*b* extending from the pivot pin 144 away from the toggle member 122 and underlying the handle grip rearward portion 124*c* of the movable locking lever 124.

Figure 4:
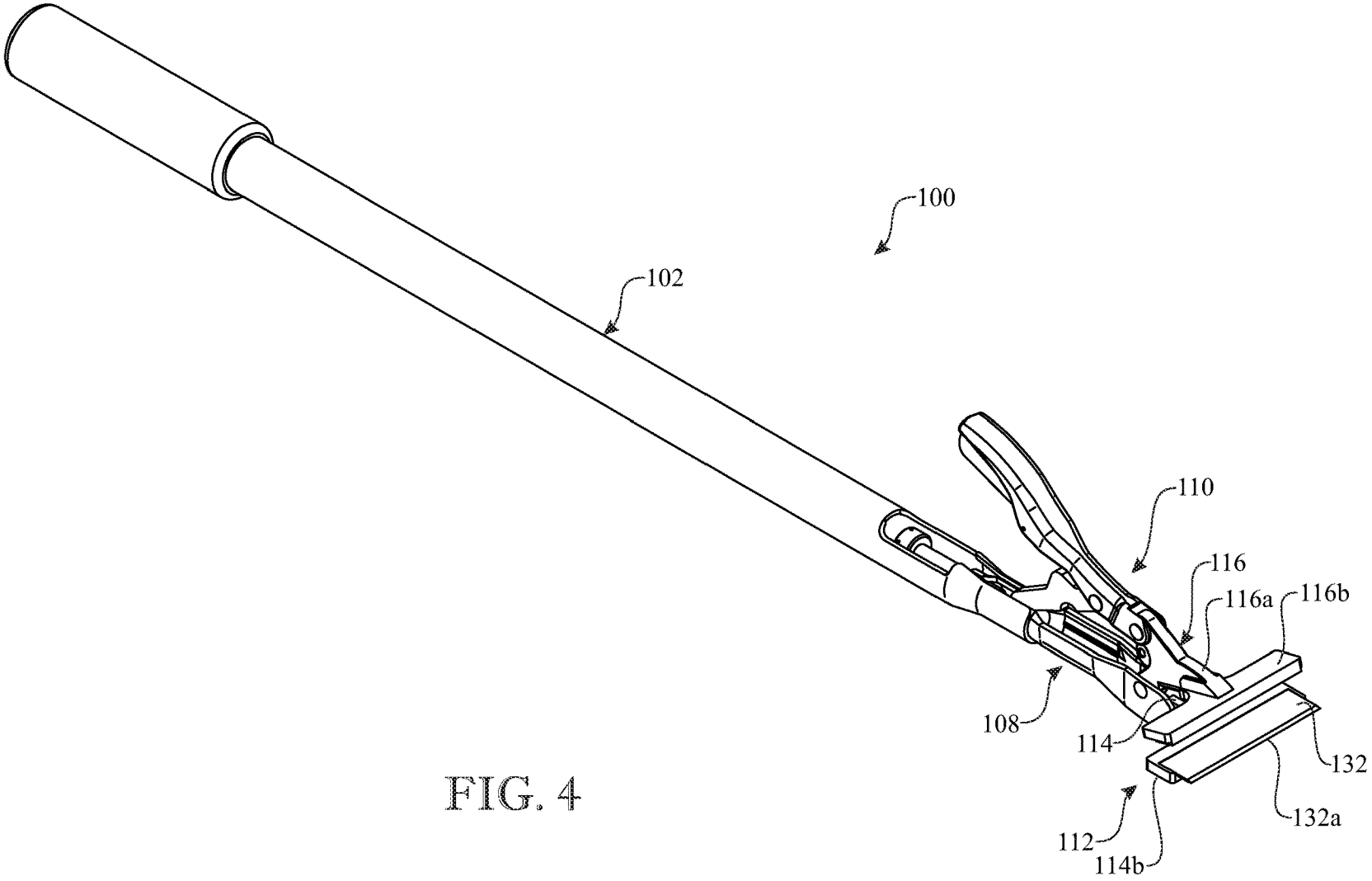
FIG. 4 presents a top front isometric view of the automated surface scraping apparatus originally introduced in FIG. 3, showing the automated scraper head in a disengaged orientation with the lower and upper jaw members of the scraper head unclamped the scraper blade with the scraper blade still seated in a recessed front lip of the lower jaw member.
Figure 5:
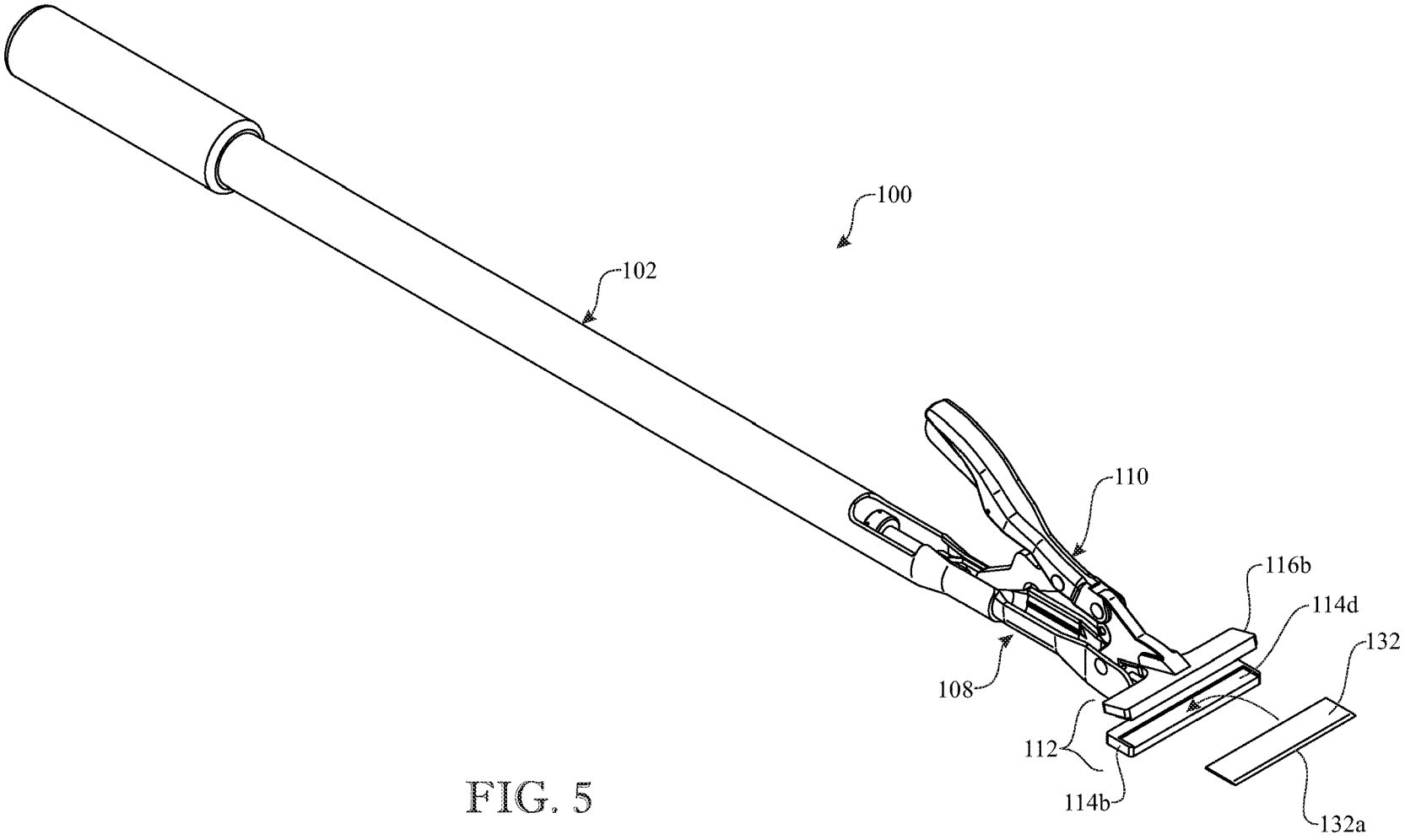
FIG. 5 presents a top front isometric view of the automated surface scraping apparatus originally introduced in FIG. 3, showing the automated scraper head in the disengaged orientation with the scraper blade now displaced forwardly of the unclamped lower and upper jaw members with an arrow showing the path along which the scraper blade is moved to seat it back in the recessed front lip of the lower jaw member.
Figure 6:
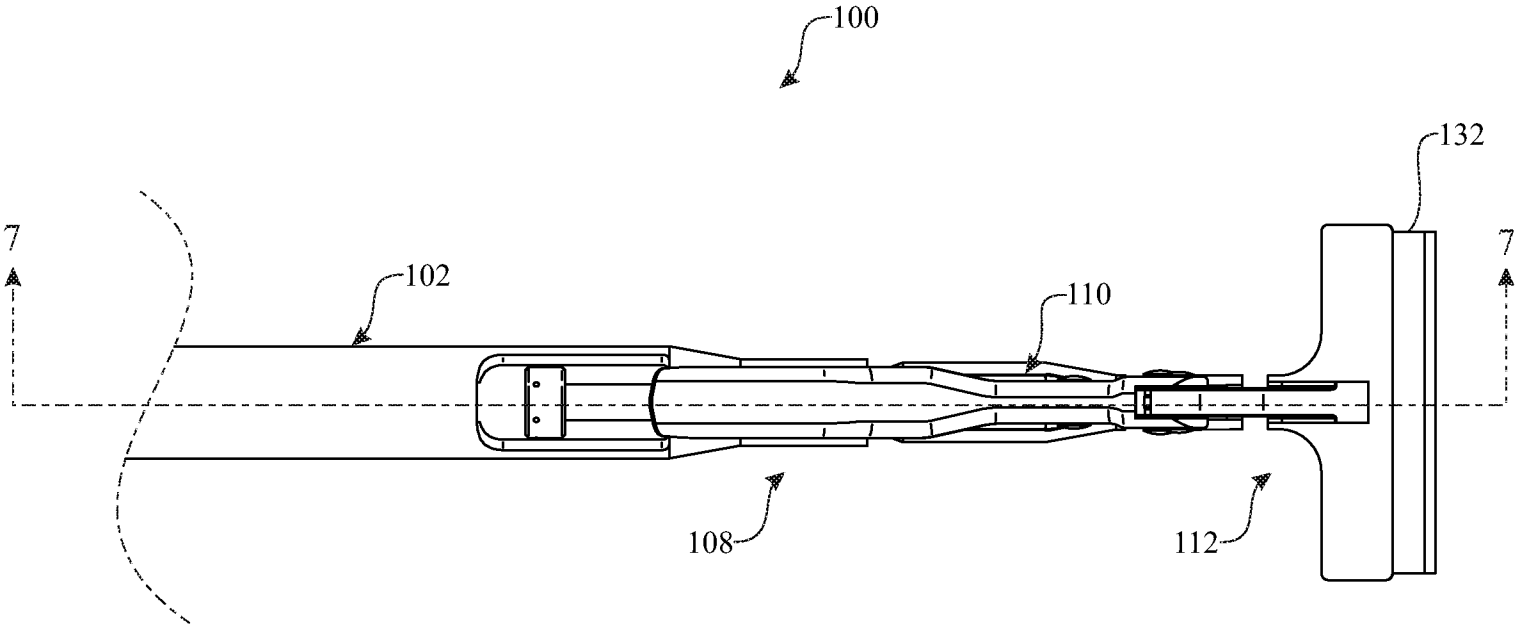
FIG. 6 presents a top plan view of the automated surface scraping apparatus originally introduced in FIG. 3, showing the automated scraper head in the disengaged orientation as seen in FIG. 4.

When the movable locking lever 124 of the locking-and-releasing mechanism 110 is disposed away from the base extension 118 at the unlocked orientation, as shown in FIGS. 4, 5 and 7, the front end 126*e* of the forward portion 126*a* of the movable releasing lever 126 is disposed in a spaced relationship above and from the second protrusion 122*c* on the toggle member 122, and also the movable upper jaw member 116 is pivoted away from the stationary lower jaw member 114 such that there is sufficient clearance between them to insert the scraper blade 132, as depicted in FIG. 5, to the position shown in FIG. 4. The adjustment screw member 120 may be rotated (and thereby moved forwardly) relative to the base extension 118 by turning the knob 130 to make a desired adjustment that, via concurrent forward movement of the toggle member 122, pivots the movable upper jaw member 116 toward the stationary lower jaw member 114 so that the scraper blade 132 is held between them. The desired adjustment of the adjustment screw member 120 also causes the movable locking member 124 to pivotally move from its unlocked orientation of FIGS. 4, 5 and 7, toward the base extension 118, to its locked orientation of FIGS. 3, 8 and 9. Concurrently, the movable releasing lever 126 is moved, relative to the toggle member 122, from its position of FIG. 7 to that of FIG. 8 so that its front end 126*c* is placed behind and engaged with the left slope of the second protrusion 122*c* on the toggle member 122 so as to retain the toggle member 122 locked in alignment with the forward portion 124*b* of the movable locking lever 124 of the locking-and-releasing mechanism 110, between the front end portion 120*c* of the adjustment screw member 120 and the upper coupler 136 of the movable upper jaw member 116 so as to retain the movable locking lever 124 at its locked orientation of FIG. 8 and the scraper blade 132 securely clamped between the stationary lower jaw member 114 and the movable upper jaw member 116 of the clamping jaw 112. The toggle member 122 and the movable locking lever 124 can be unlocked by squeezing the rearward portion 126*b* of the movable releasing lever 126 to move slightly clockwise about the pivot pin 144 toward the handle grip rearward portion 124*c* of the movable locking lever 124 and out of engagement with the second protrusion 122*c* on the toggle member 122 such that the clamping jaw 112, the toggle member 122 and the movable locking and releasing levers 124, 126 are able to assume their respective positions as shown in FIG. 7.

The above-described automated surface scraping apparatus 100 may be provided in various sizes, by changing the length of its handle 102. For example, a handle of an extended length, such as four feet, may be provided for stand up scraping, of a regular length, such as two feet, for closer hands-on scraping, and short versions for lightweight easy carry and more accurate precise usage so as to be able to get into small areas. The scraper blades may be provided in different sizes, such as four inches or eight inches in width.

Figure 10:
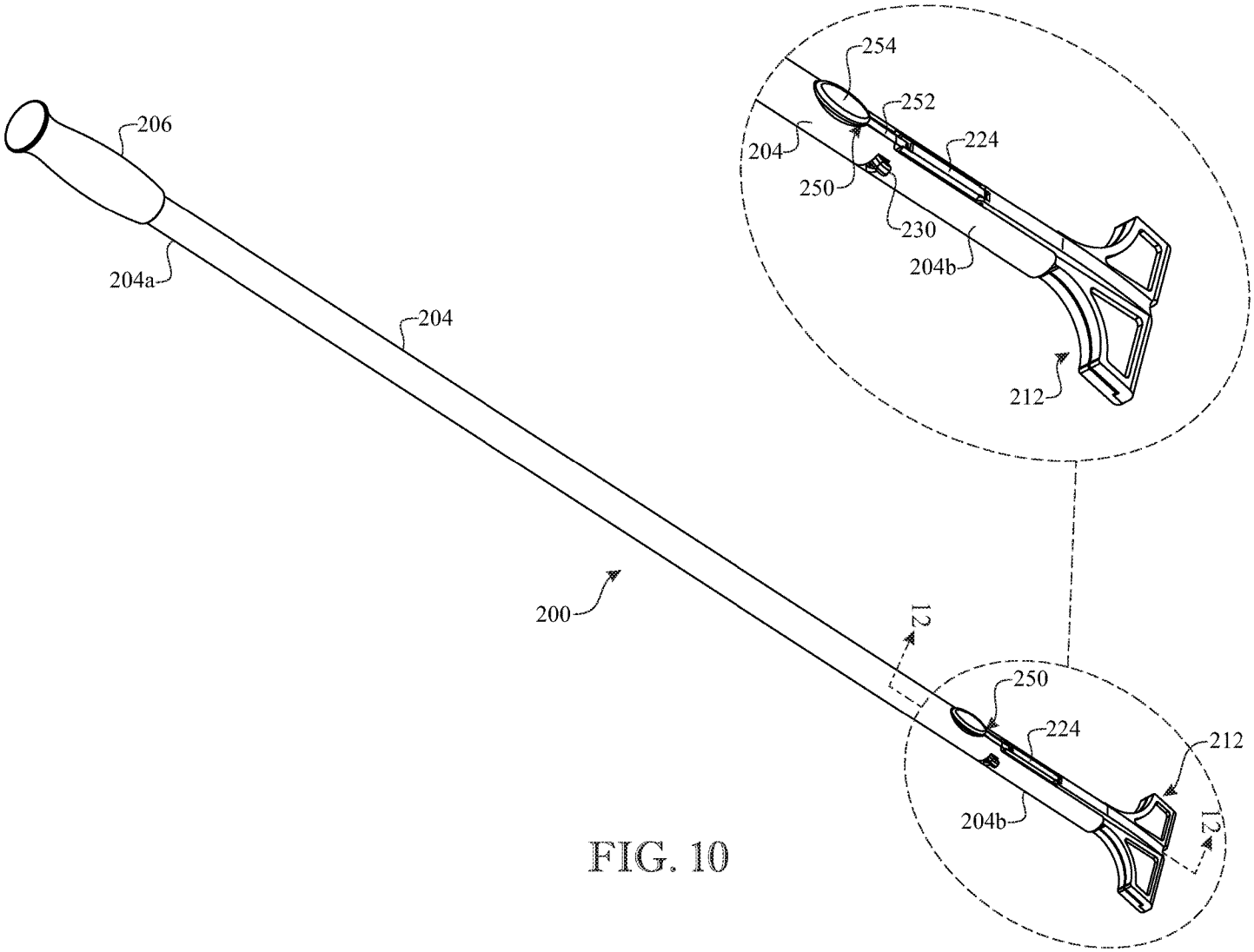
FIG. 10 presents a top isometric view of another exemplary embodiment of an automated surface scraping apparatus in accordance with aspects of the present invention, showing also an enlargement of a circled front end portion of the apparatus.
Figure 11:
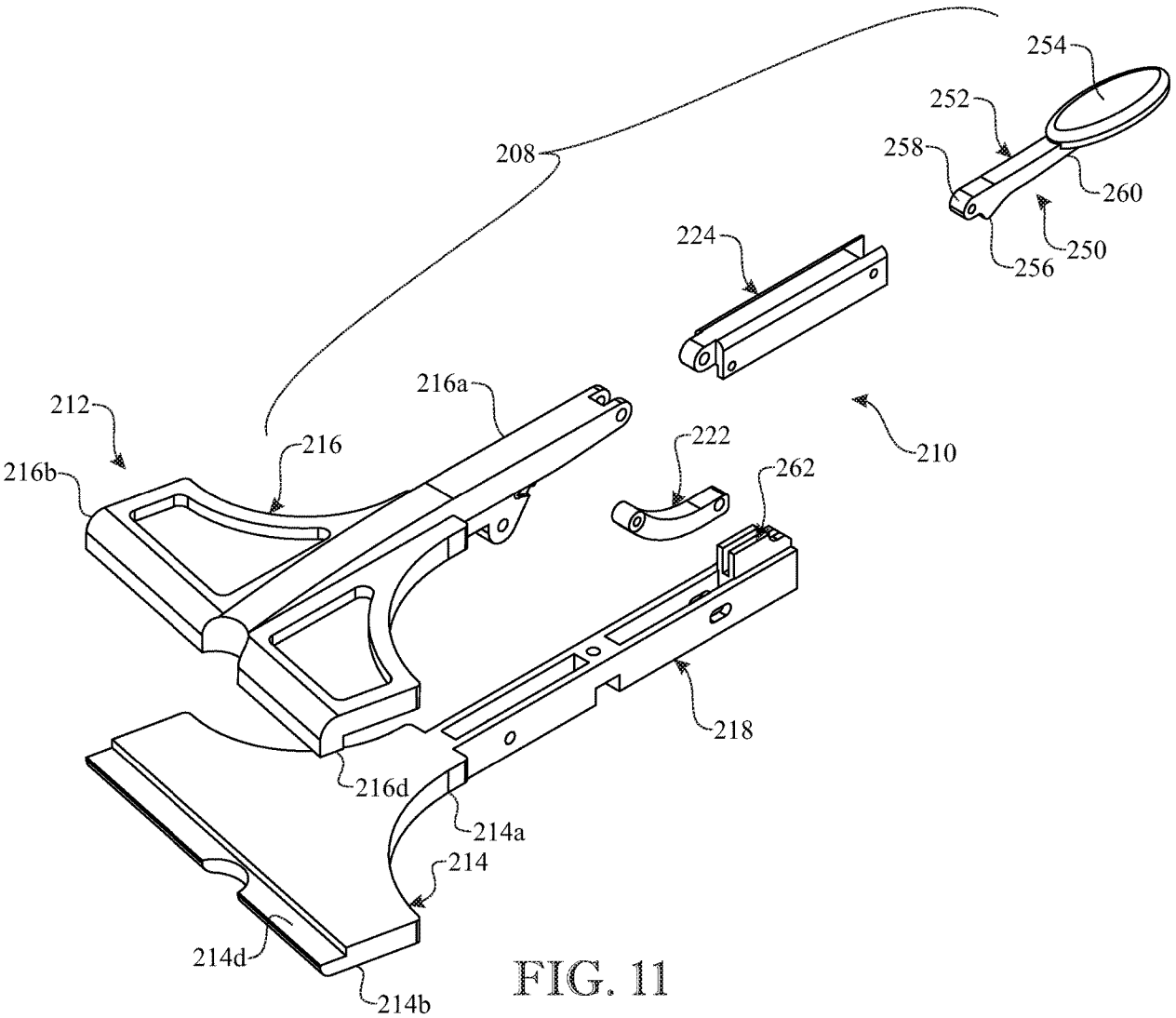
FIG. 11 presents an enlarged exploded isometric view of the front end portion of the apparatus as circled in FIG. 10.
Figure 12:
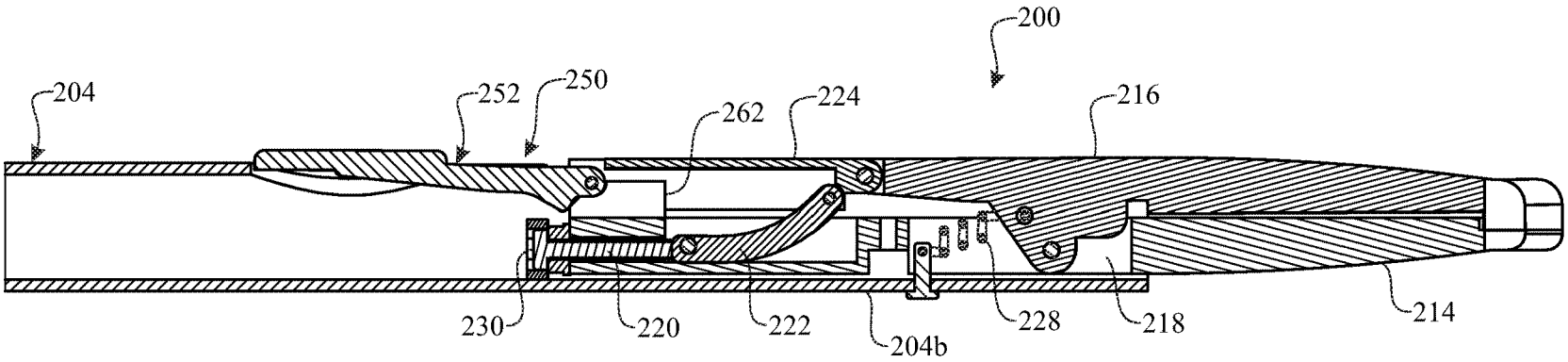
FIG. 12 presents an enlarged longitudinal section view of the front end portion of the apparatus as circled and seen along section line 12--12 in FIG. 10.

A second exemplary embodiment of the automated surface scraping apparatus in accordance with aspects of the present invention and generally designated 200 is illustrated in FIGS. 10-12. Although the form and shape of various features of the apparatus 200 vary with respect to those of the apparatus 100, the two embodiments are substantially similar in their structural elements and the functional cooperation between the structural elements. Thus, the similar structural elements of the apparatus 200 are numbered the same as those of the apparatus 100 with the proviso that the reference numerals of the similar structural elements of apparatus 200 are preceded by the numeral '2'. In view of the structural and functional similarity between the elements of the apparatuses 100 and 200, an understanding of the apparatus 200 may be readily realized, and thus will not be repeated hereafter, by referring to the foregoing detailed description of apparatus 100 subject to the foregoing proviso. Only modifications to the apparatus 100 that are incorporated by apparatus 200 will be described hereafter.

One modification is an actuating mechanism 250 which includes a releasing lever 252, a push button 254 on the releasing lever, and a protrusion 256 on the releasing lever. The releasing lever 252 is disposed along the front end portion 204*b* of the elongated handle shaft 104 and has a front end 258 pivotally coupled to a rear end 224*c* of a locking lever 224. The push button 254 is affixed on a rear end 260 of the releasing lever 252. The protrusion 256 is affixed on the releasing lever 252 below and offset rearward from the front end 258 of the releasing lever. The protrusion 256 is disposed in a cam action relationship with a bracket 262 on the base extension 218 disposed above the adjustment screw member 220 such that by a user pressing on the push button 254 the locking lever 224 is pivoted away from the toggle member 222 and thereby converted from a locked orientation to a unlocked orientation relative to the toggle member thereby enabling pivotal movement of the upper jaw member 216 relative to the lower jaw member 214 from an engaged orientation to a disengaged orientation so as to enable a scraper blade to be inserted, or removed from, between the upper and lower jaw members of the clamping jaw 212.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. An automated surface scraping apparatus, comprising:

an elongated handle shaft; and an automated scraper head comprising a base extension fixedly attached to, and disposed along a front end portion of, said elongated handle shaft, said base extension and said front end portion of said elongated handle shaft both having hollow portions and being slotted along at least respective upper sides of said hollow portions so as to form channels therein with said base extension being at least partially disposed within said channel of said front end portion of said elongated handle shaft, a clamping jaw comprising lower and upper jaw members pivotally movable toward and away from one another between disengaged and engaged orientations relative to a scraper blade, each of said lower and upper jaw members having a forward clamping portion and a rearward coupling portion integrally connected to one another, said rearward coupling portion of said lower jaw member being affixed to said base extension and extending forwardly from said base extension and said front end portion of said elongated handle shaft, said rearward coupling portion of said upper jaw member pivotally coupled at a first location thereon to said base extension, and a locking-and-releasing mechanism pivotally coupled to said rearward coupling portion of said upper jaw member at a second location thereon spaced from said first location and coupled to said rearward coupling portion of said upper jaw member at an intermediate location thereon spaced between said first and second locations, said locking-and-releasing mechanism also being mounted to said base extension and actuatable by a user to convert between unlocked and locked orientations relative to said clamping jaw so as to cause pivotal movement of said upper jaw member relative to said lower jaw member between said disengaged and engaged orientations to effect corresponding unclamping and clamping of the scraper blade by said clamping jaw;

wherein said forward clamping portions of said lower and upper jaw members project laterally in opposite directions to opposite sides thereof disposed beyond and in a transverse relationship to respective opposite sides of said base extension, said elongated handle shaft and said locking-and-releasing mechanism; and also wherein said forward clamping portion of said lower jaw member has a lower front recess formed therein and said forward clamping portion of said upper jaw member has an upper front lip formed thereon, said lower front recess and upper front lip respectively extending between said opposite sides of said forward clamping portions of said lower and upper jaw members and beyond said respective opposite sides of said base extension, said elongated handle shaft and said locking-and-releasing mechanism, said lower front recess and upper front lip having respective dimensions that receive and clamp therebetween the scraper blade at opposite upper and lower surfaces thereof.

2. The apparatus of claim 1 wherein said locking-and-releasing mechanism of said automated scraper head comprises an adjustment screw member at least partially disposed within said channel of, and being rotatably and threadably mounted to, said base extension of said automated scraper head.

3. The apparatus of claim 2 wherein said locking-and-releasing mechanism of said automated scraper head also comprises a toggle member having a rear end engaged with a front end of said adjustment screw member such that said toggle member is movable along, and relative to, said base extension upon rotation of said adjustment screw member relative to said base extension.

4. The apparatus of claim 3 wherein said locking-and-releasing mechanism of said automated scraper head also comprises a locking lever pivotally connected at a front end to said second location on said rearward coupling portion of said upper jaw member of said clamping jaw, said locking lever also pivotally connected to a front end of said toggle member at a location on said locking lever between said front end and a rear end of said locking lever but closer to said front end than to said rear end of said locking lever.

5. The apparatus of claim 4 wherein said locking-and-releasing mechanism of said automated scraper head also comprises an elongated extensible spring attached to and extending from an intermediate location on said base extension between opposite ends of said base extension to said intermediate location on said rearward coupling portion of said upper jaw member such that said elongated extensible spring is in a constant stretched state so as to impose a force upon said upper jaw member and thereby upon said locking lever to maintain said rear end of said toggle member engaged with said front end of said adjustment screw member as said upper jaw member pivotally moves toward and away from said lower jaw member.

6. The apparatus of claim 5 wherein said locking-and-releasing mechanism of said automated scraper head also comprises a knob affixed at a rear end of said adjustment screw member and being rotatable by a user to threadably adjust the position of said adjustment screw member relative to and along said base extension and thereby said front end of said adjustment screw member relative to said rear end of said toggle member to thereby urge said locking lever to assume a locked orientation relative to said toggle member such that said lower and upper jaw members assume said engaged orientation relative to the scraper blade.

7. The apparatus of claim 6 wherein said locking-and-releasing mechanism of said automated scraper head also comprises a releasing lever having an intermediate portion pivotally coupled to said locking lever, a rear portion disposed adjacent to a rear portion of said locking lever, and a forward end engaged with an intermediate portion of said toggle member so as to place said locking-and-releasing mechanism at said locked orientation such that by a user squeezing said releasing lever at said rear portion thereof toward said rear portion of said locking lever said releasing lever disengages from said toggle member and thereby said locking-and-releasing mechanism converts from said locked orientation to said unlocked orientation thereby enabling pivotal movement of said upper jaw member relative to said lower jaw member from said engaged orientation to said disengaged orientation so as to enable the scraper blade to be inserted, or removed from, between said upper and lower jaw members of said clamping jaw.

8. An automated surface scraping apparatus, comprising:

an elongated handle shaft;

an automated scraper head comprising a base extension fixedly attached to, and disposed along a front end portion of, said elongated handle shaft, said base extension and said front end portion of said elongated handle shaft both having hollow portions and being slotted along at least respective upper sides of said hollow portions so as to form channels therein with said base extension being at least partially disposed within said channel of said front end portion of said elongated handle shaft, a clamping jaw comprising lower and upper jaw members pivotally movable toward and away from one another between disengaged and engaged orientations relative to a scraper blade, each of said lower and upper jaw members having a forward clamping portion and a rearward coupling portion integrally connected to one another, said rearward coupling portion of said lower jaw member being affixed to said base extension and extending forwardly from said base extension and said front end portion of said elongated handle shaft, said rearward coupling portion of said upper jaw member being pivotally coupled at a first location thereon to said base extension, and a locking-and-releasing mechanism pivotally coupled to said rearward coupling portion of said upper jaw member at a second location thereon spaced from said first location and coupled to said rearward coupling portion of said upper jaw member at an intermediate location thereon spaced between said first and second locations, said locking-and-releasing mechanism also being mounted to said base extension and actuatable by a user to convert between unlocked and locked orientations relative to said clamping jaw so as to cause pivotal movement of said upper jaw member relative to said lower jaw member between said disengaged and engaged orientations to effect corresponding unclamping and clamping of the scraper blade by said clamping jaw; and an actuating mechanism disposed along said front end portion of said elongated handle shaft and pivotally coupled to said locking-and-releasing mechanism such that by a user pressing on said actuating mechanism said locking-and-releasing mechanism converts from said locked orientation to said unlocked orientation thereby enabling pivotal movement of said upper jaw member relative to said lower jaw member from said engaged orientation to said disengaged orientation so as to enable the scraper blade to be inserted, or removed from, between said upper and lower jaw members of said clamping jaw;

wherein said forward clamping portions of said lower and upper jaw members project laterally in opposite directions to opposite sides thereof disposed beyond and in a transverse relationship to respective opposite sides of said base extension, said elongated handle shaft and said locking-and-releasing mechanism;

also wherein said forward clamping portion of said lower jaw member has a lower front recess formed therein and said forward clamping portion of said upper jaw member has an upper front lip formed thereon, said lower front recess and upper front lip respectively extending between opposite sides of said forward clamping portions of said lower and upper jaw members and beyond said respective opposite sides of said base extension, said elongated handle shaft and said locking-and-releasing mechanism, said lower front recess and upper front lip having respective dimensions that receive and clamp therebetween the scraper blade at opposite upper and lower surfaces thereof.

9. The apparatus of claim 8 wherein said forward clamping portions of said lower and upper jaw members also have configurations that flare forwardly and laterally in opposite directions from said respective opposite sides of said base extension, said elongated handle shaft and said locking-and-releasing mechanism.

10. The apparatus of claim 8 wherein said locking-and-releasing mechanism of said automated scraper head comprises an adjustment screw member at least partially disposed within said channel of, and being rotatably and threadably mounted to, said base extension of said automated scraper head.

11. The apparatus of claim 10 wherein said locking-and-releasing mechanism of said automated scraper head also comprises a toggle member having a rear end engaged with a front end of said adjustment screw member such that said toggle member is movable along, and relative to, said base extension upon movement of said adjustment screw member along and relative to said base extension.

12. The apparatus of claim 11 wherein said locking-and-releasing mechanism of said automated scraper head also comprises a locking lever pivotally connected at a front end to said second location on said rearward coupling portion of said upper jaw member of said clamping jaw, said locking lever also being pivotally connected at a rear end to said actuating mechanism and pivotally connected at a location between said front end and said rear end, but closer to said front end than to said rear end, to said front end of said toggle member, said locking lever being convertible between said unlocked and locked orientations relative to said clamping jaw upon movement of said toggle member between said unlocked and locked orientations with said locking lever.

13. The apparatus of claim 12 wherein said locking-and-releasing mechanism of said automated scraper head also comprises an elongated extensible spring attached to and extending from an intermediate location on said base extension between opposite ends of said base extension to said intermediate location on said rearward coupling portion of said upper jaw member such that said elongated extensible spring is in a constant stretched state so as to impose a force upon said upper jaw member and thereby upon said locking lever to maintain said rear end of said toggle member engaged against said front end of said adjustment screw member as said upper jaw member pivotally moves toward and away from said lower jaw member.

14. The apparatus of claim 13 wherein said locking-and-releasing mechanism of said automated scraper head also comprises a knob affixed at a rear end of said adjustment screw member and being rotatable by a user to threadably adjust the position of said adjustment screw member relative to and along said base extension and thereby said front end of said adjustment screw member relative to said rear end of said toggle member to thereby urge said locking lever to assume a locked orientation relative to said toggle member such that said lower and upper jaw members assume said engaged orientation relative to the scraper blade.

15. An automated surface scraping apparatus, comprising:

an elongated handle shaft having a hand grip attached on a rear end portion of said elongated handle shaft opposite to a front end portion thereof;

an automated scraper head comprising a base extension fixedly attached to, and disposed along said front end portion of, said elongated handle shaft, said base extension and said front end portion of said elongated handle shaft both having hollow portions and being slotted along at least respective upper sides of said hollow portions so as to form channels therein with said base extension being at least partially disposed within said channel of said front end portion of said elongated handle shaft, a clamping jaw comprising lower and upper jaw members pivotally movable toward and away from one another between disengaged and engaged orientations relative to a scraper blade, each of said lower and upper jaw members having a forward clamping portion and a rearward coupling portion integrally connected to one another, said rearward coupling portion of said lower jaw member being affixed to said base extension and extending forwardly from said base extension and said front end portion of said elongated handle shaft, said rearward coupling portion of said upper jaw member being pivotally coupled at a first location thereon to said base extension, and a locking-and-releasing mechanism pivotally coupled to said rearward coupling portion of said upper jaw member at a second location thereon spaced from said first location and coupled to said rearward coupling portion of said upper jaw member at an intermediate location thereon spaced between said first and second locations, said locking-and-releasing mechanism also being mounted to said base extension and actuatable by a user to convert between unlocked and locked orientations relative to said clamping jaw so as to cause pivotal movement of said upper jaw member relative to said lower jaw member between said disengaged and engaged orientations to effect corresponding unclamping and clamping of the scraper blade by said clamping jaw; and an actuating mechanism disposed along said front end portion of said elongated handle shaft and having a front end portion pivotally coupled to said locking-and-releasing mechanism and also disposed in a cam action relationship with said base extension of said automated scraper head such that by a user pressing on said actuating mechanism said locking-and-releasing mechanism converts from said locked orientation to said unlocked orientation thereby enabling pivotal movement of said upper jaw member relative to said lower jaw member from said engaged orientation to said disengaged orientation so as to enable the scraper blade to be inserted, or removed from, between said upper and lower jaw members of said clamping jaw;

wherein said forward clamping portions of said lower and upper jaw members project laterally in opposite directions to opposite sides thereof disposed beyond and in a transverse relationship to respective opposite sides of said base extension, said elongated handle shaft and said locking-and-releasing mechanism;

also wherein said forward clamping portion of said lower jaw member has a forwardly and upwardly facing lower front recess formed therein and said forward clamping portion of said upper jaw member has a forwardly and downwardly projecting upper front lip formed thereon, said lower front recess and upper front lip respectively extending between opposite sides of said forward clamping portions of said lower and upper jaw members and beyond said respective opposite sides of said base extension, said elongated handle shaft and said locking-and-releasing mechanism, said lower front recess and upper front lip having respective dimensions that receive and clamp therebetween the scraper blade at opposite upper and lower surfaces thereof.

16. The apparatus of claim 15 wherein said forward clamping portions of said lower and upper jaw members also have configurations that flare forwardly and laterally in opposite directions from said respective opposite sides of said base extension, said elongated handle shaft and said locking-and-releasing mechanism.

17. The apparatus of claim 15 wherein said locking-and-releasing mechanism of said automated scraper head comprises:

an adjustment screw member at least partially disposed within said channel of, and being rotatably and threadably mounted to, said base extension of said automated scraper head;

a toggle member having a rear end engaged against a front end of said adjustment screw member such that said toggle member is movable along, and relative to, said base extension upon rotation of said adjustment screw member relative to said base extension; and a locking lever pivotally connected at a front end to said second location on said rearward coupling portion of said upper jaw member of said clamping jaw, said locking lever also pivotally connected to a front end of said toggle member at a location on said locking lever between said front end and a rear end of said locking lever but closer to said front end than to said rear end of said locking member.

18. The apparatus of claim 17 wherein said locking-and-releasing mechanism of said automated scraper head also comprises an elongated extensible spring attached to and extending from an intermediate location on said base extension between opposite ends of said base extension to said intermediate location on said rearward coupling portion of said upper jaw member such that said elongated extensible spring is in a constant stretched state so as to impose a force upon said upper jaw member and thereby upon said locking lever to maintain said rear end of said toggle member engaged with said front end of said adjustment screw member as said upper jaw member pivotally moves toward and away from said lower jaw member.

19. The apparatus of claim 17 wherein said locking-and-releasing mechanism of said automated scraper head also comprises a knob affixed at a rear end of said adjustment screw member and being rotatable by a user to threadably adjust the position of said adjustment screw member relative to and along said base extension and thereby said front end of said adjustment screw member relative to said rear end of said toggle member to thereby urge said locking lever to assume a locked orientation relative to said toggle member such that said lower and upper jaw members assume said engaged orientation relative to the scraper blade.

20. The apparatus of claim 19 wherein said actuating mechanism comprises:

a releasing lever disposed along said front end portion of said elongated handle shaft and having a front end pivotally coupled to said rear end of said locking lever;

a push button affixed on a rear end of said releasing lever; and a protrusion affixed on said releasing lever below and offset rearward from said front end of said releasing lever and disposed in said cam action relationship with a bracket on said base extension disposed above said adjustment screw member such that by the user pressing on said push button of said releasing lever said locking lever is pivoted away from said toggle member and thereby converted from said locked orientation to said unlocked orientation relative to said toggle member thereby enabling pivotal movement of said upper jaw member relative to said lower jaw member from said engaged orientation to said disengaged orientation so as to enable the scraper blade to be inserted, or removed from, between said upper and lower jaw members of said clamping jaw.

* * * * *